United States Patent [19]

Singer

[11] Patent Number: 4,630,346

[45] Date of Patent: Dec. 23, 1986

[54] ARTICLE FORMING METHOD

[76] Inventor: Steven M. Singer, 408 Northlake Ct., Apt. 306, North Palm Beach, Fla. 33408

[21] Appl. No.: 714,114

[22] Filed: Mar. 20, 1985

[51] Int. Cl.[4] ..... B23P 5/00

[52] U.S. Cl. ..... 29/160.6; 29/10; 164/35; 164/45; 264/221; 264/225

[58] Field of Search ..... 29/160.6, 10; 164/34, 164/35, 44, 45; 264/220, 221, 225–227

[56] References Cited

U.S. PATENT DOCUMENTS

| | | | |
|---|---|---|---|
| 2,790,220 | 4/1957 | Fox | 164/35 |
| 3,356,129 | 12/1967 | Anderko et al. | 264/221 |
| 4,153,662 | 5/1979 | Descovich et al. | 264/227 |

FOREIGN PATENT DOCUMENTS

| | | | |
|---|---|---|---|
| 2311644 | 12/1976 | France | 164/34 |

*Primary Examiner*—Howard N. Goldberg
*Assistant Examiner*—P. W. Echols
*Attorney, Agent, or Firm*—Leonard Bloom

[57] ABSTRACT

A method of making jewelry or the like to enhance the retention of a gem to a retaining bezel area of the jewelry, comprising the steps of obtaining and utilizing the gem as a model initially, casting the gem in a moldable material, allowing the moldable material to set, dividing the set moldable material into segments to expose the gem, thereby providing a recess in at least two divided moldable material segments thus formed, removing the gem to expose the recesses, casting into the recesses a material which is soluble in the presence of a fluid so that the cast material has an external configuration of the gem when set, allowing the cast material to set, removing the cast material from the recesses of the moldable material, crafting a temperature sensitive substance about the cast material to form the bezel area and attendant jewelry, removing the set soluble material in the presence of the fluid, vaporizing the temperature sensitive substance with molten material using a lost wax process, allowing the molten material to set, polishing the set molten material, and placing the gem into the bezel area of the set molten material whereby retention of the gem is enhanced.

4 Claims, 1 Drawing Figure

ARTICLE FORMING METHOD

BACKGROUND OF THE INVENTION

The following invention relates generally to a method for forming an article and the article formed thereby.

More particularly, the invention embraces a method of casting, and in a preferred form, a method for casting jewelry and the article formed thereby. A gem, valuable stone or its equivalent is used to form a replica thereof, a gem holder is formed by crafting a material against the replica, then removing the replica, replacing the gem holder with a finished material by using the "lost wax" process, and thereafter installing the gem.

One of the most nettlesome problems in the possession of a valuable entity (ie, a jewel or gem) secured in a displaying support has been the fear of losing the valuable entity by dislodgement from its support. Constraints are placed upon the formation of a support which include not deforming, marring or in other ways distorting, and thereby altering the worth of, the gem which is to be displayed. Thus, a problem exists which has been longstanding in the production of a support for an associated gem which reliably fastens the gem to the support.

The following citations reflect the state of the art of which applicant is aware insofar as the citations appear pertinent to the process at hand.

| Patent Number | Inventor | Date of Issuance |
|---|---|---|
| 2,118,468 | Jungersen | May 24, 1938 |
| 2,163,814 | Swarovski | June 27, 1939 |
| 2,887,746 | Bogoff | May 26, 1959 |
| 4,154,282 | Kull | May 15, 1979 |
| 4,392,289 | Michaud | July 12, 1983 |

Michaud teaches the use of a manufacture of jewelry by casting, utilizing pre-set gems initially disposed in wax. Thereafter, a "lost wax process" is utilized to replace the wax with metal securing the gem in intimate contact therewith. It should be noted that utilizing this technique requires that the gem be placed adjacent the wax when the wax is removed in favor of a metal which is molten. Thus, the gem experiences elevated temperatures which in some applications can be detrimental.

Similarly, Bogoff teaches the use of a supporting member for a jewel, the method including forming a first sectional rubber mold with a cavity in one section complimental to the forward face of the jewel and having narrow, resilient retaining tongues formed to extend over border portions of the jewel to hold same in position, the balance of the cavity formed in the other of the mold sections to define a full back cover for a jewel, so that putting a jewel in the cavity section of the one mold with tongues holding the jewel in place and thereafter casting will mount the jewel with the metal.

Swarovski provides a method for setting stones in which the stone is placed within a mold in a supporting socket which covers the crown of the stone completely except for the clamping surfaces, and pouring a molten plastic material into the mold while pressing the stone into the socket to provide the article.

Kull places a stone into a preformed mold surrounding portions of the gem with waxlike material, and thereafter heating molten hardenable metal material and introducing the same into the mold cavity which diffuses the waxlike material and binds to the gem to anchor the latter in an article of jewelry.

Thus, it should be manifest that in many of the known prior art techniques, the gem itself is placed in elevated temperatures which can be detrimental. Alternatively, where mass produced articles are to be fabricated, the gem is held such that the retaining areas of the molten material are exposed for a single step process. None of the citations teach or render obvious, either singly or any conceivable combination, those aspects to which the instant application addresses itself.

SUMMARY AND OBJECTS OF THE INVENTION

Accordingly, this invention has as its primary objective the provision of a new and novel technique for enhancing the degree of contact between first and second components wherein the second component is to support the first, and an article formed thereby.

It is a further object of this invention to provide a device as characterized above which reliably secures a precious gem with an associated bezel area of support for the gem.

It is yet a further object of this invention to provide a device as characterized above which, by the very nature of the process disclosed hereinafter, intrinsically provides greater fidelity along the area of interface between the gem and its associated support. In this manner, a higher degree of surety has been reached that the gem will not become inadvertently dislodged for the attendant benefits.

It is a further object of this invention to provide a device, as characterized above, which lends itself to assimilation readily by other known prior art techniques so that no substantive hardship is encountered in adopting the new technique.

It is another object of this invention to provide an article and method which tends to reduce the amount of time required in fastening a gem, since manual crafting in fitting the gem in the support will be held to a minimum due to the fidelity with which the gem corresponds to its associated support bezel.

Another object of this invention promulgates unrestricted creativity in the design by eliminating the use of traditional gem retention devices like various pre-made findings.

These and other objects will be made manifest considering the following detailed specifications when taken in conjunction with the appended drawing figure wherein there has been provided a method of making jewelry or the like to enhance the retention of a gem to a retaining bezel area of the jewelry, comprising the steps of obtaining and utilizing the gem as a model initially, casting a moldable material about the gem, allowing the moldable material to set, dividing the set moldable material to expose the gem by providing a recess in at least two divided moldable material segments thus formed, removing the gem to expose the recesses, casting into the recesses a material which is soluble in the presence of a fluid so that when set, the cast material has the external configuration of the gem, allowing the cast material to set, removing the cast material from the recesses of the moldable material, crafting a temperature sensitive substance about the cast material to form the bezel area and attendant jewelry, removing the set soluble material in the presence of the fluid, vaporizing the temperature sensitive substance using a lost wax process with a molten material like gold or silver, allowing the molten material to set, polishing the set molten material, and placing the gem into the bezel area of the set molten material whereby retention of the gem is enhanced by virtue of the improved interconnection area.

BRIEF DESCRIPTION OF THE DRAWING FIGURE

The FIGURE is a block representation of the methodology associated with the instant invention.

DESCRIPTION OF THE PREFERRED EMBODIMENT

Figure 1:
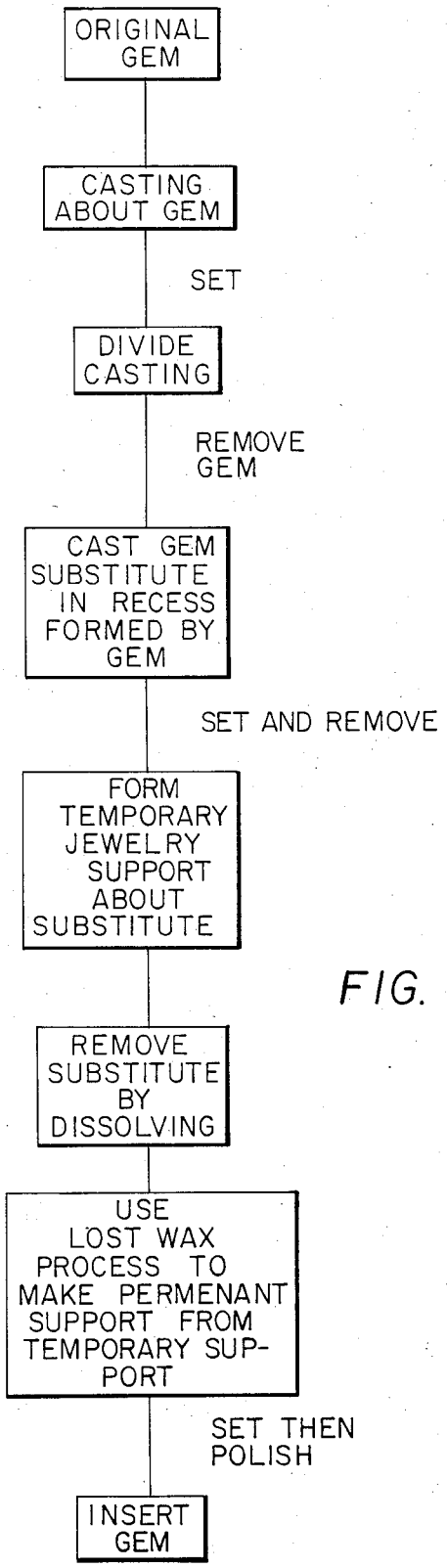

Referring to the drawing now, there has been shown a block diagram representative of one method for forming the article.

In one of its broader aspects, the method for forming the article of jewelry includes replacing a component, which in this case is a valuable gem, with a replica. This is effected by taking the gem and casting the gem within a moldable material which is preferably transparent when set. Setting is enhanced by heating the cast molded material and gem for one-half hour at 350° F. Once the moldable material has set, a scalpel or its equivalent is used to extricate the gem from the mold so that a recess is formed within the mold having a contour corresponding identically to the outer surface of the gem. Typically, the moldable material is cut into two sections along an axis of symmetry of the gem though this is not necessarily required. In addition, the transparent nature of the molded material allows the artisan to perform precision work. It is possible that the recess resides fully in one of the segments of the molded material when separated depending upon the contour of the gem in which event the entire mold cavity is found on one mold surface segment. Alternatively, the gem can be removed by providing a plurality of segments, the totality of which when assembled defines the reason within which the gem was cast. In any event, it is essential that the gem be removed in such a way that the dimensions of the gem be reflected with absolute fidelity by the recess.

Thereafter, the component (or the gem) is replaced by a replica which is formed from a material which is soluble in a fluid, more particularly a liquid, and most particularly, water. The replica material is formed primarily from Elmer's type glue, an investment casting compound, corn starch and salt to form a paste. In any event, the recess formed within the moldable material provides the contour which the replica follows when the replica material is placed therein and allowed to set. Thus, a replica is set into the recess of the set moldable material and the cast material has a total correspondence to the external configuration of the gem.

This replica thereafter serves as a model upon which an artisan will work wax in placing a wax retainer along certain faces of the model gem so that the retainer corresponds to the jewelry bezel or any other article which serves as a support for the gem or component. Typically, the bezel is a crafted component retainer, is formed from wax and is sculpted about the replica to correspond to the finished article of metal jewelry within which the gem is to reside. Once the wax temporary component or gem retainer has been fabricated about the replica, it is together with the replica placed in water or its equivalent to remove the model. After the model has dissolved the remaining wax model is subjected to the "lost wax process". In lost wax casting, it is necessary to remove the wax from the casting flask before the molten metal is injected into the flask. This is done by heating the flask a few hours at around 1000° F. The introduction of molten metal within a sprue fills cavities left by the wax. Thus, the wax, once removed and then replaced by the metal, provides a bezel support so that the associated article of jewelry corresponds identically to the external dimensions of the gem. The configuration of the bezel support adjacent the replica corresponds to an external configuration of the gem. Preferrably, the replica is to be removed from the wax sculpture of the metal by immersion of the wax and replica in water before the lost wax process.

In view of the foregoing, it is apparent that while a specific example with respect to jewelry has been delineated, the method associated herewith is equally compatible in other casting environments, for example dentistry, in which one component is adapted to be placed in intimate tangential contact with a support structure to assure that the component and its area of interconnection with the support structure is one in which the areas of tangency exist as intended. The technique according to the instant application insures that air gaps, pockets, and other variations in the contour of the coterminous faces will not exist but rather, will be of the highest order of quality so that the objects associated with the instant application can be realized.

Thus, a method for working metal which is adapted to hold a gem or the like has been disclosed. More particularly, the actual gem, which is to be held in a precious metal ring, broach, necklace, earring or the like, is first embedded in a moldable transparent material and completely encased therein. One type of commercially available molding material is Ferris see thru flexible mold compound. Once the material has been set, the molded material is cut away from the gem such that at least two portions are provided, and a recess which reflects the configuration of the gem is exposed. A substitute for the gem is then fabricated in the recess using material which is readily soluble in water, and wax work is done around the gem model (replica). When the wax is completed, the wax and replica are placed in water. The replica dissolves, leaving the wax, and the wax is then cast using the lost wax process. The metal is then filed and polished, and the gem is set in the metal so that the surface areas of the metal which are intended to grasp the real gem tend to reflect the contour of the gem with greater fidelity, thereby improving the grasp of the metal on the gem when placed in the metal.

Moreover, having thus described the invention, it should be apparent that numerous structural modifications are contemplated as being a part of this invention as set forth hereinabove and as defined hereinbelow by the claims.

What is claimed is:

1. A method of making jewelry to enhance the retention of a gem in a retaining bezel area of the jewelry, comprising the steps of:

obtaining and utilizing the gem as a model initially, casting the gem in a moldable material, allowing the moldable material to set, dividing the set moldable material to expose the gem, providing a recess in at least two divided moldable material segments thus formed, removing the gem from the set moldable material to expose the recesses, casting into the recesses a material which is soluble in the presence of a fluid and aligning the recesses so that when set, the cast material has the external configuration of the gem, allowing the cast material to set, removing the cast material from the recesses of the moldable material, crafting a temperature sensitive but fluid impervious substance about and against the cast material to form the bezel area for the gem, so that the cast material cannot be removed therefrom without destroying either the cast material or the said crafted bezel area, allowing the temperature sensitive substance to set;

removing the cast material in the presence of the fluid, vaporizing the temperature sensitive substance using a lost wax process having molten material, allowing the molten material to set, polishing the set molten material, and placing the gem into the bezel area of the set molten material, whereby retention of the gem is enhanced.

2. A method of casting to improve interfit between one component and its associated cast support including the steps of:

obtaining and utilizing the one component as a model initially, casting the one component in a moldable material, allowing the moldable material to set, dividing the set moldable material to expose the one component, removing the one component from the set moldable material to expose cavities, whereby at least two separate segments are formed having cavities formed therein, casting into the cavities a material which is soluble in the presence of a fluid and aligning the cavities so that the cast material has an external configuration of the one component when set, allowing the cast material to set, removing the cast material from the cavities of the moldable material, crafting a temperature sensitive, fluid impervious substance about and against the cast material to form the support area for the one component so that the cast material cannot be removed therefrom without destroying either the cast material or the said crafted support area, allowing the temperature sensitive substance to set, removing the cast material in the presence of the fluid, vaporizing the temperature sensitive substance using a lost wax process having molten material, allowing the molten material to set, polishing the set molten material, and placing the one component into the support area of the set molten material, whereby retention of the one component is enhanced.

3. A method of making jewelry having a bezel area to retain a stone therein, comprising, in combination, the steps of:

casting a moldable material about the entire exterior surface of the stone;

allowing the castable moldable material to set;

separating the set, casted moldable material into at least two separate segments to expose the stone;

removing the stone from the set, casted moldable material, whereby at least two separate segments are formed having cavities therein being of such a shape that when aligned said cavities are substantially identical to the configuration of the stone;

casting a soluble material in each respective cavity of the separated segments;

aligning the cavities of the separated segments having the soluble material therein;

allowing the casted soluble material to set, forming a soluble replica of the stone having a substantially identical coincidence as the external configuration of the stone;

removing the set soluble replica from the separate segments;

fashioning a substantially liquid, temperature sensitive but fluid impervious wax about and adhering to the replica, so that the replica cannot be removed therefrom withut being destroyed;

allowing the wax to set;

crafting and marking the wax with decorative patterns desired to be exhibited on the jewelry having the bezel area;

dissolving the replica in a liquid;

vaporizing the temperature sensitive wax using a lost wax process having a molten metal, whereby the molten metal replaces the wax;

allowing the molten material to set, whereby the jewelry having a bezel area to retain a stone therein, is formed.

4. A method of making jewelry having a setting to retain a gem therein, comprising, in combination, the steps of:

forming a replica of the gem, said replica having an external configuration being substantially identical to the external configuration of the gem;

crafting a temporary wax gem retainer having an artistic design thereon about the replica, said retainer adhering substantially to the external configuration of the replica so that said replica cannot be physically removed from the temporary retainer without substantially destroying the artistic design thereon or without destroying the replica;

destroying the replica in situ without affecting the artistic design of the setting of the temporary retainer;

forming a permanent setting of cast metal having the artistic design thereon from the temporary setting by a lost wax process;

installing the gem in the cast metal fitting with a minimum of adjustments thereto, whereby the gem is securely held.

* * * * *